United States Patent [19]

Tabatznik et al.

[11] 4,219,032

[45] Aug. 26, 1980

[54] SMOKING DEVICE

[76] Inventors: Robert A. Tabatznik, Box 97, Boiceville, N.Y. 12412; Steven H. Reiner, deceased, late of Bronx, N.Y., by Jack P. Reiner, administrator

[21] Appl. No.: 855,923

[22] Filed: Nov. 30, 1977

[51] Int. Cl.[3] ..... A24F 47/00; A24F 1/08

[52] U.S. Cl. ..... 131/170 A; 131/173

[58] Field of Search ..... 131/173, 170 R, 171 A, 131/170 A, 194

[56] References Cited

U.S. PATENT DOCUMENTS

| | | | |
|---|---|---|---|
| 2,104,266 | 1/1938 | McCormick | 131/170 R |
| 2,815,030 | 12/1957 | Wenger | 13/173 |

*Primary Examiner*—Stephen C. Pellegrino
*Attorney, Agent, or Firm*—Ernest F. Marmorek

[57] ABSTRACT

A smoking device for extracting at least one smoke component from a smokeable substance comprises a bowl defining a space for receiving the smokeable substance, the bowl having a pair of spaced holes therein; and a container defining a chamber for receiving a heat source, the chamber communicating with the space through one of the holes in the bowl whereby the smoke component may be extracted by drawing through the other hole in the bowl. A method for extracting a smoke component from a smokeable substance is also disclosed.

9 Claims, 2 Drawing Figures

SMOKING DEVICE

BACKGROUND OF THE INVENTION

1. Field of the Invention

This invention pertains to smoking devices and more particularly to pipes of the type wherein an extracted smoke component is cooled by drawing it through a suitable liquid. Most particularly, this invention pertains to pipes of the type described but incorporating novel means for extracting a smoke component from the smokeable substance. The invention also pertains to methods for extracting a smoke component from a smokeable substance.

2. Statement of the Prior Art

Pipes of all types are, of course, well known. The advantages of liquid-cooled pipes, that is, pipes of the type wherein the smoke is drawn through a suitable liquid to reduce its harshness before being inhaled, are now well recognized in the art.

For example, U.S. Pat. No. 4,031,906 discloses a pipe having a bowl for receiving a smokeable substance which communicates with a liquid filled chamber through a pair of tubes. The open end of another tube, which serves as a pipe stem, is disposed in the reservoir below the water line. Consequently, by igniting the smokeable substance and inhaling at the free end of the pipe stem smoke is drawn from the bowl through the liquid reservoir and into the user's mouth. U.S. Pat. No. 4,029,109 discloses a liquid cooled pipe in which the smoke is drawn through a plurality of cylindrically disposed tubular members disposed in the liquid before it is finally drawn into the user's mouth. In addition to providing an elongated path through the liquid for enhancing the cooling effect, the arrangement also serves to segregate ash deposits from the liquid flow to prevent contamination of the reservoir. Finally, both U.S. Pat. Nos. 3,209,764 and 3,209,765 disclose pipes which may be converted from conventional liquid-cooled pipes to direct smoking pipes. In addition, these pipes incorporate means for reducing the amount of condensation in the smoke being drawn into the user's mouth.

These and all other prior art pipes known to applicants effect extraction of the smoke from the smokeable substance in a conventional manner. That is, they all rely on direct ignition of the smokeable substance by a match, lighter or other suitable flame source. Then, as the smokeable substance burns, the smoke is drawn through the liquid reservoir and into the user's mouth by inhaling at the stem.

SUMMARY OF THE INVENTION

According to the invention, we have developed a novel pipe of the water-cooled variety which effects extraction, from a smokeable substance, of those components which characterize the smokeable substance, without the necessity of directly igniting the smokeable substance. For convenience sake, those components will be hereinafter referred to as "smoke components". The smokeable substance itself may comprise tobacco, corn silk, cannabis or any other smokeable material. In the case of tobacco, the smoke components are those that give tobacco its characteristic taste and aroma.

In the embodiment of the invention preferred at present, this is accomplished by placing a housing, preferably in the shape of a miniature pot, above a more or less conventional bowl in which the smokeable substance is disposed. The bottom of the housing is perforated to accommodate the passage of hot gases from the housing to the bowl. As is usual, the bowl communicates with a liquid reservoir through a suitable conduit and a stem communicates with the liquid reservoir above the water line for drawing smoke from the bowl through the reservoir and into the user's mouth.

In use, a suitable heat source, preferably a combustible substance such as a suitable quantity of charcoal, is disposed in the housing and ignited. Preferably, the housing will be removably secured to the bowl so that the ignited charcoal may first reach its optimum temperature before being placed in proximity to the smokeable substance. The housing is thereafter secured to the bowl. When the user then inhales through the stem, hot combustion gases from the burning charcoal are drawn down into the bowl via the perforations in the housing. The hot combustion gases extract smoke components from the smokeable substance, without, however, completely decomposing the smokeable substance into ash as occurs in direct ignition pipes.

As a result, the smoke components extracted from the smokeable substance and drawn into the user's mouth have been found to be cooler than would be the case if the same smokeable substance were smoked in a direct ignition pipe. Also, the method of extracting smoke components made possible by the pipe of the invention renders the pipe safer than direct ignition pipes since the quantity of those substances suspected of being carcinogenic which are extracted from the smokeable substance by our pipe is believed to be reduced and possibly eliminated. This results from the fact that the pyrolytic conversion which produces the substances in direct ignition pipes does not occur when the liquid-cooled pipe of the invention is used. In addition, it has been found that the time required to substantially complete extraction of the smoke components is longer than when pipes employing pyrolitic conversion are used. As a result, the duration of user satisfaction is also increased.

These and other changes, modifications and advantages of the smoking device of the present invention will be more fully appreciated from the following detailed description and annexed drawing of the preferred embodiment thereof.

DETAILED DESCRIPTION OF THE PREFERRED EMBODIMENT

Figure 1:
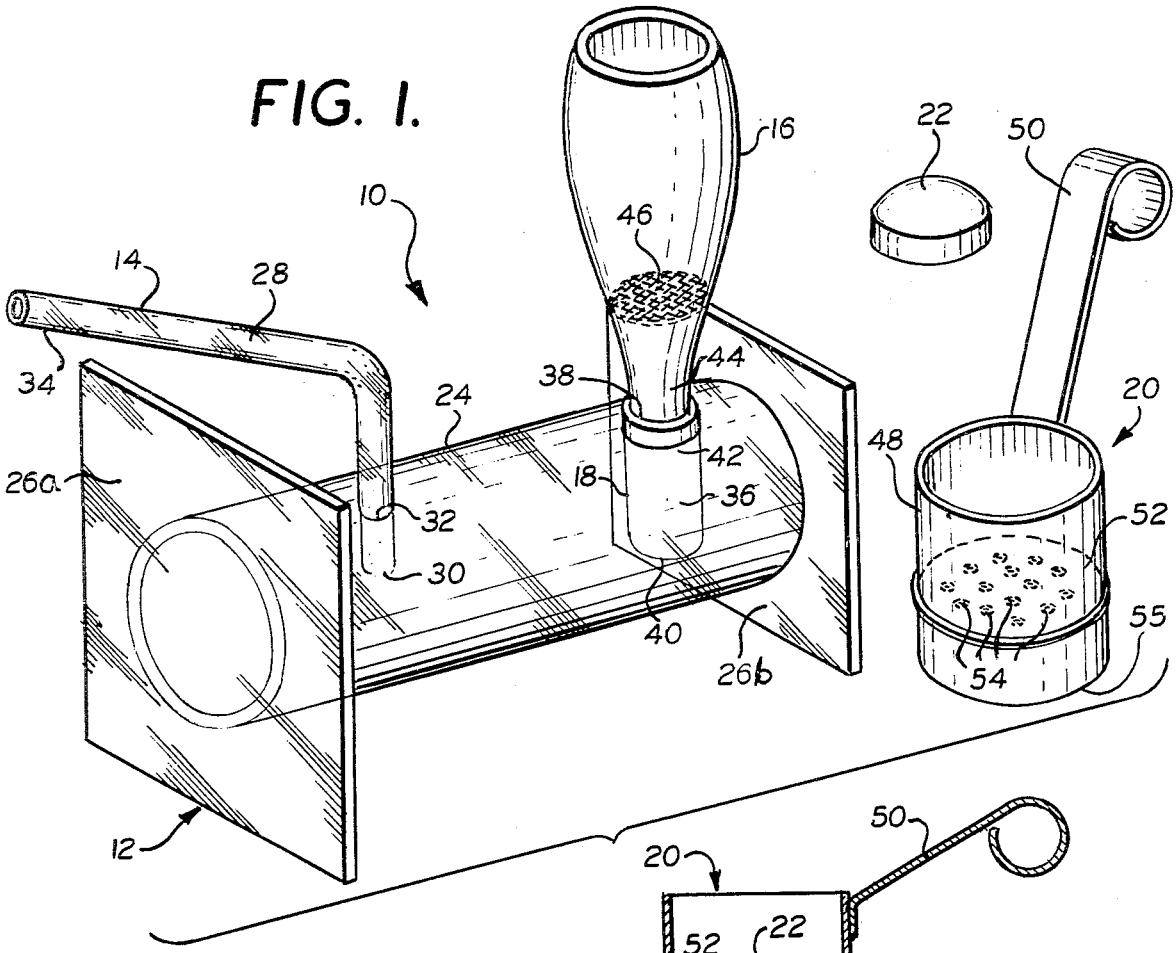
FIG. 1 is a partially exploded perspective view illustrating the preferred liquid-cooled smoking device according to the present invention.

Referring now to the drawing, the preferred embodiment of the liquid-cooled pipe 10 of the present invention is illustrated. As shown, the pipe 10 includes a liquid reservoir 12, a pipe stem 14, a bowl 16, a conduit 18, and a housing 20 for a heat source.

Figure 2:
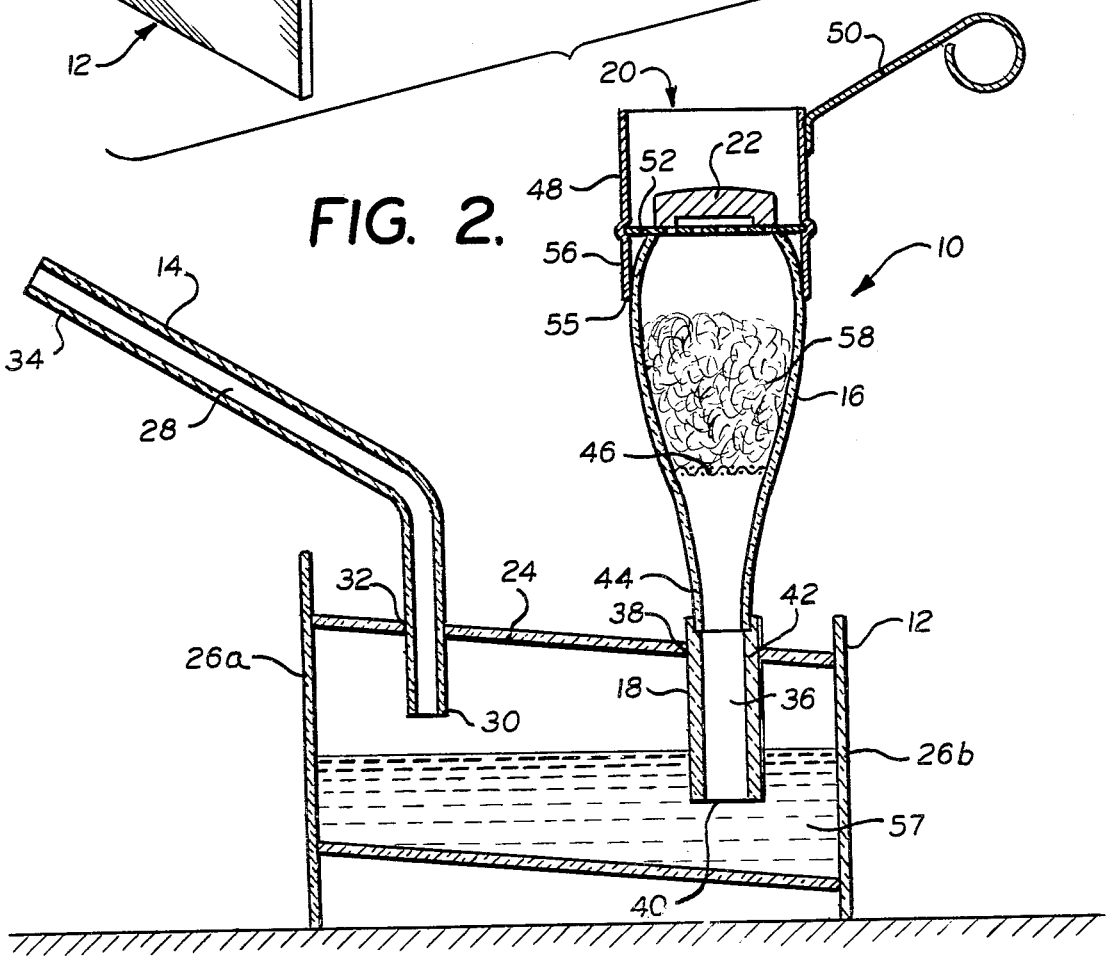
FIG. 2 is a view in longitudinal section of the smoking device illustrated in FIG. 1.

The reservoir 12 preferably comprises a generally cylindrical hollow member 24 supported at its ends by a pair of square legs 26. For reasons that will be more fully apparent hereinafter, and as best shown in FIG. 2, the cylindrical member 24 is supported by the legs 26 at an angle to the horizontal. The member 24 and legs 26 may be comprised of any suitable material although plastic, and particularly Lucite, is preferable. In forming the reservoir 12, cylindrical member 24 and legs 26 will preferably be separately formed and joined together as, for example, by a suitable adhesive. When joining the legs 26 to the member 24, care should be taken to insure a substantially hermetic seal as it has been found that the effect produced by the pipe 10 of the present invention will thereby be enhanced.

As presently preferred and shown, the stem 14 of the pipe 10 comprises a generally L-shaped tubular member having a passage 28 extending longitudinally therethrough. One end 30 of the stem 14 extends through an aperture 32 in the upwardly facing portion of the cylindrical member 24. The other end 34 of the stem 14 serves as the point of draw for the user. Like cylindrical member 24 and legs 26, stem 14 is also preferably comprised of plastic. For reasons that will be more fully apparent hereinafter, the lower end of stem 14 is preferably secured to the base 12 by dimensioning the stem for an interference fit with the aperture 32.

As shown, the conduit 18 has a channel 36 therethrough and extends through another aperture 38 in the upper portion of the wall of cylindrical member 24. For reasons that will be explained hereinafter, the lower end 40 of the conduit 18 extends into the reservoir 12 below the point of communication of end 30 of stem 14 with the reservoir. Preferably, the upper end 42 of the conduit 18 will be joined to the wall defining aperture 38 by a suitable adhesive, care again being taken to insure that the seal between the base 12 and the conduit 18 is substantially hermetic. The conduit 18 is also preferably plastic. As shown, the preferred bowl 16 comprises a generally funnel-shaped member, which, being subject to heat during use, is selected from among those materials which will not melt at the maximum temperature of the heat source. For this purpose, porcelain and other ceramic materials are preferred. Preferably, the lower end 44 of the bowl 16 is dimensioned to be received in the upper end 42 of the conduit 18 and is preferably fixedly secured thereto by a suitable adhesive. Once again, the seal between the conduit 18 and the bowl 16 is preferably substantially hermetic. As shown, a screen 46 is secured in the lower portion of the bowl 16 preferably by being press-fitted in place.

As presently preferred and shown, housing 20 comprises a hollow generally cylindrical member 48 having a handle 50 and a transverse wall 52. As shown, the wall 52 has a plurality of perforations 54 and extends through the cylindrical space defined by the member 48 above the lower edge 55 thereof. Thus, and as shown, the housing 20 may be firmly seated on the bowl 16 by resting the transverse wall 52 on top of the bowl with the portion 56 of the cylinder 48 below the transverse wall 52 snugly fitted about the upper portion of the bowl 16. Since the heat source is disposed in the housing 20 which thereby becomes heated, housing 20, like bowl 16, is preferably comprised of a material which does not melt or burn at the maximum temperature of the heat source. For example, any of a variety of metal or ceramic materials well known to persons skilled in the art may be used. The heat generated by the heat source also explains the presence of handle 50 which serves to facilitate placement of housing 20 on bowl 16 as will be more fully explained hereinafter.

In use, the reservoir 12 is filled with a suitable liquid such as, for example, water or wine. This may be accomplished by removing stem 14 and pouring the liquid in through the aperture 32. Skilled art workers will recognize, however, that access to the reservoir 12 could also be provided through an additional opening (not shown) which could be sealed, for example, by a plug. In any event, the reservoir 12 should be filled to a level such that the lower end 40 of the conduit 18 is immersed in the liquid 57 while the lower end 30 of the stem 14 is above it.

With the housing 20 removed from the bowl 16, a suitable smokeable substance 58 is disposed in the bowl above the screen 46. The smokeable substance may comprise pipe tobacco or any other suitable smokeable material. Whatever smokeable substance is used, skilled art workers will recognize that the mesh of the screen 46 should be sufficiently fine to prevent the smokeable substance 58 from passing through the screen and contaminating the reservoir 12. With the housing 20 desirably still separated from the bowl 16, a suitable heat source, which may comprise a heating coil or, as shown in the drawing, a suitable quantity of charcoal 22, is placed in the cylindrical member 48 above the transverse wall 52. The charcoal is then ignited and allowed to burn until it is at or near its optimum temperature. Thereafter, using handle 50, the housing 20 is disposed on top of bowl 16 as shown in FIG. 2.

When the user draws on the pipe through the end 34 of the stem 14, the suction created at the lower end 40 of the conduit 16 will draw heat from the burning charcoal 22 down through the smokeable substance 58 into the bowl 16. When this is done, it has been found that the smoke components are extracted from the smokeable substance 58 without decomposing the smokeable substance into ash as is the case with direct ignition pipes. Thus, whatever smokeable substance is used, it has been found that when all the smoke components are extracted, the smokeable substance is not reduced to an ash-like residue, but rather is more or less in its original form, although slightly discolored. In addition to the other advantages already mentioned, this reduces the possibility of the fine granular ash from passing through the screen 46 and into the reservoir 12. Moreover, the time required to substantially complete extraction of the smoke components is greater than the time required when conventional pipes are employed. Thus, the pipe of the invention also increases the period of enjoyment.

The smoke components thus extracted pass through the screen 46 into the conduit 18 and then into the liquid reservoir 12 where they are cooled by the water 57 before emerging above the water line. The smoke components are then drawn through the lower end 30 of the stem passage 28 and into the user's mouth. As best shown in FIG. 2, because the cylindrical member 24 is tilted, the vertical extent of the air space near the lower end 30 of the stem 14 is greater than that near the conduit 18. This not only permits a greater extent of the conduit 18 to be submerged and thus cooled, but also lessens the density of smoke components accumulating near the lower end 30 of stem 14. As is well known to users of liquid-cooled pipes, the accumulation of smoke components near the end of the stem disposed in the reservoir can, despite the cooling effect, result in a particularly harsh draw.

Skilled art workers will recognize that a variety of changes and modifications in the preferred pipe 10 described above may be made. Thus, the shapes and orientations of the various parts of the pipe 10 may be modified. Moreover, although preferable, it is not absolutely necessary that the housing 20 be disposed above bowl 16 and it could be disposed on the side thereof as long as there is communication between the space defined by the bowl which houses the smokeable substance 58 and the heat generated by combustion of the combustible substance 22. Also, skilled art workers will recognize that means other than the screen 46 may be devised for preventing passage of the smokeable substance 56 through the conduit 18. Similarly, means other than perforated transverse wall 52 may be employed for preventing passage of the decomposed combustible substance 22 into the bowl 16.

Finally, while it has been found that the pipe 10 functions best when the reservoir is partially filled with a suitable liquid, this too is not absolutely necessary, and the pipe 10 will function even without any liquid in the reservoir.

Since these as well as other changes and modifications are within the scope of the present invention, the above description should be construed as illustrative and not in the limiting sense, the scope of the invention being defined by the following claims:

We claim:

1. A smoking device for extracting at least one smoke component from a smokeable substance, comprising:

a hollow base defining a reservoir, said base having ingress and egress apertures therein;

a bowl defining a space for receiving the smokeable substance, said bowl having two spaced holes therein, means establishing intercommunication between the space and the reservoir through the ingress aperture in the base and one of the holes in the bowl; and heating means including a perforated container defining a chamber for receiving a combustible substance, the chamber communicating with the space through the other hole in the bowl, and disposed adjacent the other of the holes in the bowl for elevating the smokeable substance to a sufficiently high temperature to extract the smoke component through the egress aperture without combusting the smokeable substance.

2. A smoking device according to claim 1, and further comprising:

a conduit extending from the base and having a channel extending therethrough, the conduit being disposed intermediate the bowl and the base for communication between the space and the reservoir through the channel; and a liquid disposed in the base for partially filling the reservoir to a predetermined level, said channel communicating with said reservoir below said level.

3. The smoking device according to claim 1, wherein said container comprises a cylindrical member having a transverse wall at one end, said wall having a plurality of perforations therein, said container being removably securable to said bowl with said transverse wall overlying said other hole.

4. The smoking device according to claim 3, and further comprising a screen disposed in the lower portion of the bowl for blocking passage of the smokeable substance from the space to the reservoir.

5. The smoking device according to claim 1, wherein said base comprises a generally cylindrical member closed at both ends; and further comprising means for supporting said cylindrical member at an angle to the horizontal.

6. The smoking device according to claim 1, and further comprising a stem having a passage therethrough, said passage communicating with said reservoir through said egress aperture.

7. A method of extracting a smoke component from a smokeable substance without burning said smokeable substance, comprising the steps of subjecting a combustible substance to combustion to form a hot gas, drawing said hot gas through said smokeable substance, refraining from further heating the gas during passage through said smokeable substance, and thereafter passing the hot gas through a liquid, whereby the gas is cooled and at least one smoke component is extracted from said smokeable substance.

8. A method according to claim 7, further comprising the steps of disposing the combustible substance and the smokeable substance in sufficiently close proximity to one another to prevent cooling of the hot combustion gas it passes through the smokeable substance.

9. A method according to claim 8, wherein said liquid is water or wine.

* * * * *